US007833081B2

(12) United States Patent
Hippely et al.

(10) Patent No.: US 7,833,081 B2
(45) Date of Patent: Nov. 16, 2010

(54) TOY VEHICLE HAVING FANCIFUL FACIAL EXPRESSION

(75) Inventors: Keith Hippely, Manhattan Beach, CA (US); Mike Andrews, Los Angeles, CA (US); Chris Down, Torrance, CA (US); Mark Mayer, Woodland Hills, CA (US); Mark Trageser, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 285 days.

(21) Appl. No.: 11/594,433

(22) Filed: Nov. 7, 2006

(65) Prior Publication Data

US 2007/0178804 A1 Aug. 2, 2007

Related U.S. Application Data

(60) Provisional application No. 60/734,512, filed on Nov. 7, 2005, provisional application No. 60/734,511, filed on Nov. 7, 2005.

(51) Int. Cl.
*A63H 17/26* (2006.01)

(52) U.S. Cl. ..... 446/465; 446/470

(58) Field of Classification Search ..... 446/269, 446/280, 337, 342, 343, 436, 462, 465, 470
See application file for complete search history.

(56) References Cited

U.S. PATENT DOCUMENTS 3,131,508 A 5/1964 Brown
3,305,966 A * 2/1967 Thornell ..... 446/141
3,482,352 A 12/1969 Helm
3,621,608 A 11/1971 Bosley et al.
3,648,408 A 3/1972 Terzian et al.
3,660,932 A 5/1972 Raffeli et al.
3,780,470 A 12/1973 Roberts et al.
3,828,469 A 8/1974 Giroud
4,139,968 A 2/1979 Milner
4,294,033 A 10/1981 Terzian
4,424,978 A * 1/1984 Kassai ..... 280/1.13
4,683,669 A 8/1987 Greer, Jr.
4,767,374 A 8/1988 Yang
4,775,352 A 10/1988 Curran et al.
5,108,341 A 4/1992 DeSmet
5,306,197 A 4/1994 Watanabe
5,407,376 A * 4/1995 Avital et al. ..... 446/175
5,656,907 A 8/1997 Chainani et al.
5,697,829 A 12/1997 Chainani et al.
5,769,687 A 6/1998 Ko
5,823,847 A 10/1998 Gellman
5,908,345 A 6/1999 Choi
6,039,626 A * 3/2000 Gerold et al. ..... 446/175
6,053,798 A 4/2000 Tang
6,068,536 A * 5/2000 Madland et al. ..... 446/337
6,079,985 A 6/2000 Wohl et al.
6,083,104 A 7/2000 Choi
6,250,987 B1 6/2001 Choi (Continued)

*Primary Examiner*—John Ricci
(74) *Attorney, Agent, or Firm*—Edell, Shapiro & Finnan

(57) ABSTRACT

A toy vehicle includes a body supported by a plurality of wheels. The body also includes a roof and rear window supporting a plurality of user inputs. Within the toy vehicle body, a microprocessor controlled drive and steering mechanism is operative. The operation of the microprocessor is set by the user inputs. The body further supports a movable bumper mouth and movable eyes and eyebrows behind the windshield.

20 Claims, 12 Drawing Sheets

U.S. PATENT DOCUMENTS

| | | | | |
|---|---|---|---|---|
| 6,257,948 | B1 | 7/2001 | Silva | |
| 6,352,464 | B1 | 3/2002 | Madland et al. | |
| 6,354,842 | B1 | 3/2002 | Frei | |
| 6,386,942 | B1 | 5/2002 | Tang | |
| D464,382 | S | 10/2002 | Hornsby et al. | |
| 6,544,098 | B1 | 4/2003 | Hampton et al. | |
| 6,616,503 | B1 | 9/2003 | Fong | |
| 6,645,037 | B1 | 11/2003 | Choi | |
| 6,699,097 | B2 | 3/2004 | Rudell et al. | |
| 6,733,359 | B1 | 5/2004 | Jacobs | |
| 2001/0053651 | A1 | 12/2001 | Wright | |
| 2002/0177383 | A1* | 11/2002 | Hornsby et al. | 446/175 |
| 2005/0026537 | A1 | 2/2005 | Hsieh et al. | |
| 2005/0053909 | A1 | 3/2005 | Chan | |
| 2006/0105671 | A1* | 5/2006 | Connolly | 446/485 |

* cited by examiner

TOY VEHICLE HAVING FANCIFUL FACIAL EXPRESSION

CROSS-REFERENCE TO RELATED APPLICATIONS

This application claims the benefit of and priority under 35 U.S.C. 119(e) of U.S. Provisional Patent Application Ser. No. 60/734,512 entitled TOY VEHICLE HAVING FANCIFUL FACIAL EXPRESSION filed Nov. 7, 2005 in the name of Keith Hippely, the disclosure of which is incorporated herein by reference. This application also incorporates provisional patent application Ser. No. 60/734,511 filed Nov. 7, 2005 on behalf of Keith Hippely and entitled TOY VEHICLE HAVING FANCIFUL EYES which is hereby incorporated by reference.

FIELD OF THE INVENTION

This invention relates generally to toy vehicles and particularly to apparatus used therein to provide additional operative features for such toy vehicles.

BACKGROUND OF THE INVENTION

Toy vehicles have proven to be an extremely popular and long lasting type of toy product. Not surprisingly, practitioners in the art have provided a virtually endless variety of toy vehicles to address this consumer popularity and industry need. Thus, toy vehicles have been provided which are free wheeling or unpowered as well as those which are self powered. Self powered toy vehicles have included wind up motor drives as well as vehicles having battery-powered electric drive apparatus. In addition to basic drive apparatus, practitioners have endeavored to incorporate a variety of features within their toy vehicles. The objective in providing such featured toy vehicles is to increase the amusement and play value of the toy vehicle beyond simple movement play patterns. For example, U.S. Pat. No. 6,645,037 issued to Choi sets forth a PROGRAMMABLE TOY AND GAME in which a toy vehicle has a keyboard which may be activated by a user to set up a motion or multiple different motions of the toy vehicle. Sounds and lights may be activated to coordinate with the movement. The toy vehicle may assume a number of appearances. The keyboard can also be used to play a game of skill, for instance, shooting at a target.

U.S. Pat. No. 6,250,987 issued to Choi sets forth a PROGRAMMABLE TOY in which a programmable device such as a toy vehicle or novelty item includes a keyboard supported thereon which is accessible to a user. The user is able to input a motion or sequence of motion to the toy. Various sounds and light effects may be activated in coordination with the movements. While a toy vehicle is shown, different types of toys may be used.

U.S. Pat. No. 6,083,104 issued to Choi sets forth a PROGRAMMABLE TOY WITH INDEPENDENT GAME CARTRIDGE in which a toy vehicle or the like supports a keyboard on an independent cartridge with a microprocessor which may be activated by a user to selectively cooperate with the toy vehicle and set up any one of multiple motions by the toy vehicle. Sounds and lights are also provided for additional effect and may be coordinated to the toy vehicle movement. The keyboard on the cartridge may also be used independently to play a game programmed into the cartridge microprocessor.

U.S. Pat. No. 5,908,345 issued to Choi sets forth a PROGRAMMABLE TOY having a keyboard supported on the toy vehicle body. The keyboard may be activated by a user to set up a desired sequencing of motions, lights and sounds.

U.S. Pat. No. 5,697,829 issued to Chainani, et al. sets forth a PROGRAMMABLE TOY which utilizes a graphic programming system implemented on a personal computer. The programmable toy comprises a vehicle that can be instructed to make various movements and turns and, additionally, may be programmed to track an infrared source. The graphic program is created by selection of graphic objects from the control panel which are presented on a cartoon-like graphic screen.

U.S. Pat. No. 5,656,907 issued to Chainani, et al. sets forth a METHOD AND SYSTEM FOR PROGRAMMING TOYS utilizing a graphic programming system implemented on a personal computer. In the preferred embodiment, the programmable toy comprises a vehicle that can be commanded to make various turns and movements or to track an infrared source.

U.S. Pat. Nos. 3,131,508 issued to Brown; 3,482,352 issued to Helm; 3,621,608 issued to Bosley, et al.; 3,648,408 issued to Terzian, et al. and 3,780,470 issued to Roberts, et al. set forth a variety of early attempts to provide programmable toy vehicles.

In an art area generally related to the fanciful expression portion of the present invention toy vehicle, practitioners in the art have provided a number of facial expression dolls and toy figures. For example, U.S. Pat. No. 6,733,358 issued to Jacobs sets forth a TALKING ACTION FIGURE HAVING FACIAL EXPRESSIONS in which a body defining an internal cavity supports a head attached to the body. The head is deformable into a plurality of facial expressions. An electrical circuit disposed within the body cavity is operatively coupled to a sound generator. The sound generator and circuit cooperate to produce audible speech. An actuator is operatively coupled to both the head and the electrical circuit and is arranged to synchronize changes of facial expression with the sound produced.

U.S. Pat. No. 6,544,098 issued to Hampton, et al. sets forth an INTERACTIVE TOY having a small fabric-colored toy creature which displays a variety of facial expressions and which undergoes various speech routines coordinated or related to the facial expressions.

U.S. Pat. Nos. 6,068,536 and 6,352,464, a continuation thereof, both issued to Madland, et al. and both entitled MECHANISM FOR ANIMATED CHARACTER set forth a character generally resembling a food article such as an apple or the like within which a movement mechanism is supported. The figure defines a plurality of facial features which are moved by the movement mechanism.

U.S. Pat. D464,382 issued to Hornsby, et al. sets forth a TOY having a fanciful somewhat robot-like figure supported by a plurality of wheels and having extending arms displays different features upon a facial screen supported on the figure.

U.S. Pat. No. 6,616,503 issued to Fong sets forth an ANIMATION DEVICE FOR HEAD AND MOUTH OF A TOY having a cam assembly which is operative to engage the jaw of a toy figure. The cam assembly is configured for linear movement along a first axis concurrently with pivotal movement about second and third axes which extend in generally perpendicular relation to each other and to the first axis. The assembly is supported within a housing suitable for installment in a toy figure or the like.

U.S. Pat. Nos. 5,823,847 issued to Gellman; 5,769,687 issued to Ko; 5,108,341 issued to DeSmet; 4,294,033 issued to Terzian; 3,828,469 issued to Giroud and 3,660,932 issued to Raffeli, et al. set forth examples of facial expression changing apparatus for dolls and the like which generally to the facial expression changing capabilities of the present invention toy vehicle.

Other prior art devices relating generally to the subject matter of the present invention are found in U.S. Pat. No. 6,699,097 issued to Rudell, et al.; 4,775,352 issued to Curran, et al.; 4,767,374 issued to Yang and 4,683,669 issued to Greer, Jr.

U.S. Pat. No. 6,354,842 issued to Frei sets forth a ROLLING TOY WHICH MOTION RECORDING AND PLAYBACK CAPABILITY while U.S. Pat. No. 5,306,197 issued to Watanabe sets forth a KEY ACTION, MOVABLE TOY both of which relate generally to the subject of toy vehicles.

Additional prior art devices relating generally to the subject matter of the present invention are found in U.S. Pat. Nos. 6,386,942 issued to Tang; 6,257,948 issued to Silva; 6,079,985 issued to Wohl, et al.; 6,053,798 issued to Tang; Published U.S. Patent Application 2005/0026537 filed on behalf of Hsieh, et al.; Published U.S. Patent Application 2005/0053909 filed on behalf of Chan and Published U.S. Patent Application 2001/0053651 filed on behalf of Wright.

While the foregoing described prior art devices have to some extent improved the art and have in some instances enjoyed commercial success, there remains nonetheless a continuing need in the art for evermore interesting, amusing and novel toy vehicles.

SUMMARY OF THE INVENTION

Accordingly, it is a general object of the present invention to provide an improved and more interesting toy vehicle. It is a more particular object of the present invention to provide an improved and more interesting toy vehicle which is programmable and which executes a plurality of movements in response to programming. It is a still more particular object of the present invention to provide an improved programmable toy vehicle which provides coordinated facial expressions in a fanciful and entertaining manner. In accordance with the present invention, there is provided a toy vehicle having a supporting chassis which in turn supports a plurality of rolling wheels. A battery powered drive mechanism is operative to impart rotational power to the rear wheels. The front wheels are controlled by a steering mechanism supported upon the chassis. A controller operative within the toy vehicle provides for drive and steering operations for the toy vehicle. In addition, the toy vehicle includes a flexible front bumper having an elongated "mouth" formed therein. Apparatus within the toy vehicle provides for stretching and manipulation of the resilient bumper to open and close the mouth aperture and impart a "mouthing" action. The mouth moving apparatus is coupled to a linkage combination which is further operative to control a pair of simulated eye pupils moveable within the toy vehicle windshield. A pair of simulated eyebrows is also moveably supported within the toy vehicle behind the windshield and are similarly controlled by the linkage mechanism. The controller within the toy vehicle responds to user inputs via a plurality of control buttons supported upon the vehicle body to provide preprogrammed or configured operation of the toy vehicle features such as mouth and eye movement as well as traveling movement of the toy vehicle itself upon the play surface.

In another respect, the present invention provides a toy vehicle comprising: a body having a windshield aperture, a windshield, a rear window, a plurality of wheels, drive means and steering means; a pair of moveable eye pupils and means for supporting and moving the eye pupils behind the windshield; a pair of moveable eyebrows and means for supporting and moving the eyebrows behind the windshield; a deformable front bumper defining a mouth aperture therein and means for supporting and deforming the front bumper upon the body; a controller operatively coupled to the drive means and the steering means to move and steer the toy vehicle upon a play surface and to control the means for moving and supporting the eye pupils and the means for supporting the eyebrows to create facial expressions for the toy vehicle; and a plurality of user inputs supported on the rear window for providing user programming inputs to the controller.

The present invention toy vehicle provides a toy vehicle having a body, a plurality of rolling wheels and a cockpit or driver's compartment and a covering roof. The toy vehicle further includes a front windshield formed of a clear transparent material such as plastic or like. A pair of simulated eye pupils is supported behind the clear transparent windshield and is coupled to a linkage which terminates in a moveable button accessed on the roof of the toy vehicle. A pair of simulated eyebrows is moveably supported above the eye pupils and is operatively coupled to the eye pupil supporting and moving linkage. A white backing plate is secured behind the eye pupils and simulated eyebrows to provide a white eye backing. In operation, the child user utilizes manual movement of the button supported upon the vehicle roof to operate the eye support and movement mechanism to cause the eye pupils and eyebrows to be moved within the windshield area. Additional buttons are supported on the vehicle roof which are coupled to an internal sound apparatus within the toy vehicle.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

By way of overview, the present invention toy vehicle includes a molded plastic body supported upon a rolling chassis having a plurality of support wheels. The chassis further supports a battery powered motor drive mechanism as well as a steering mechanism operative upon the front wheels of the vehicle. Additional features are provided within the toy vehicle which includes a resilient deformable bumper having a simulated moveable mouth formed therein. The vehicle features further include a windshield having a pair of simulated moveable eye pupils and a pair of simulated moveable eyebrows. The eyebrows and eye pupils are utilized to provide various expressions for the toy vehicle. The eye movement is coordinated with the stretching movement of the resilient bumper through a common internal linkage mechanism to provide complex "facial" features for the vehicle. A keypad having a plurality of user input buttons is situated in the rear window of the toy vehicle and provides user input for programming of the toy vehicle operation and the operation of the toy vehicles features.

In one embodiment, within the plastic body a clear transparent windshield is supported. A pair of simulated eye pupils is supported behind the clear transparent windshield by a movement mechanism which terminates in a moveable button accessible from outside the vehicle upon the vehicles roof. A pair of simulated eyebrows is supported above the simulated eye pupils and are moveable in response to movement of the eye pupil mechanism. The combined effect of eye movement and eyebrow movement in response to movement in response to movement of the rooftop button by the user provides a fanciful eye movement and coordinated eyebrow expression characteristic. A white back plate is secured behind the transparent windshield and the simulated eye and eyebrows to further enhance the expression of the eyes and eyebrows when moving.

Figure 1:
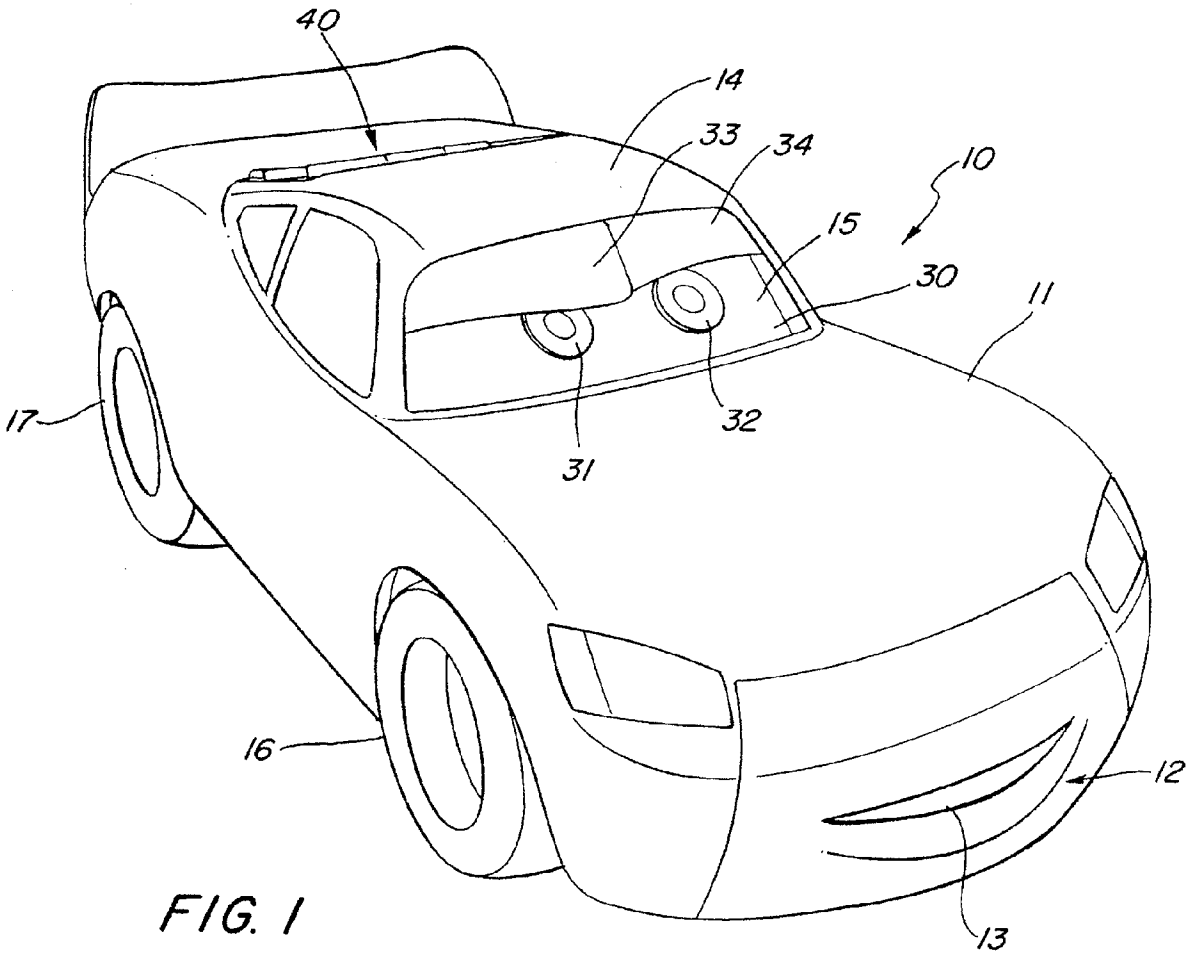
FIG. 1 sets forth a front perspective view of a toy vehicle constructed in accordance with the present invention.

More specifically, FIG. 1 sets forth a front perspective view of a toy vehicle constructed in accordance with the present invention and generally referenced by numeral 10. Toy vehicle 10 includes a molded plastic body 11 supporting a resilient front bumper 12 having a mouth 13 formed therein. Body 11 further includes a roof portion 14 and a windshield 15. Windshield 15 is formed of a clear transparent plastic material. A white backing plate 30 is supported behind windshield 15 forming a space therebetween. Within the space between windshield 15 and backing plate 30, a pair of simulated eye pupils 31 and 32 together with a pair of simulated moveable eyebrows 33 and 34 are supported. An operative mechanism within the toy vehicle (seen in FIGS. 4 through 6) is configured to shape and distort bumper 12 in order to move mouth 13 for talking movement or various expressions. This mechanism is also coupled to the apparatus supporting moveable eye pupils 31 and 32 as well as moveable eyebrows 33 and 34. In this manner, mouth movement and eye expressions may be coordinated. Body 11 further includes a roof 14 and a rear window which supports a user input keyboard 40 (better seen in FIG. 2). Toy vehicle 10 further includes a drive mechanism set forth below which is operative to impart rotational power to rear wheels 17 and 19 and to impart steering to front wheels 16 and 18 (wheels 18 and 19 seen in FIG. 2).

Figure 2:
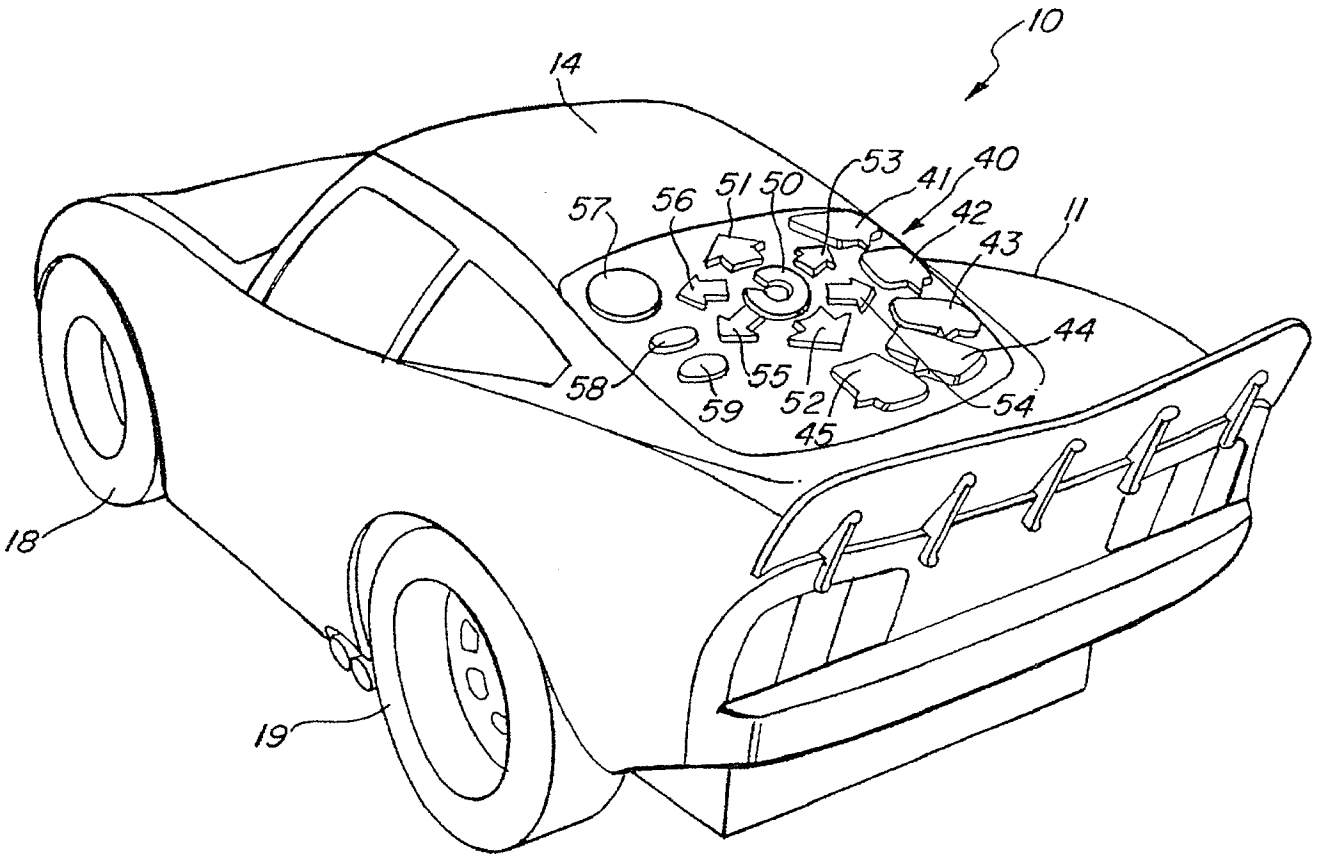
FIG. 2 sets forth a rear perspective view of the present invention toy vehicle.

FIG. 2 sets forth a rear perspective view of toy vehicle 10 which includes a molded plastic body 11 having a roof portion 14 and a keyboard 40. Toy vehicle 10 is supported upon a pair of front wheels 16 and 18 and is moved by rotational power applied to rear wheels 19 and 17 (wheels 16 and 17 seen in FIG. 1). Keyboard 40 is operative to provide user inputs to controller 110 (seen in FIG. 6) which is supported upon chassis 70 within the interior of body 11 in the manner set forth below in FIGS. 4 through 6. Keyboard 40 includes a plurality of expression input buttons 41, 42, 43 and 44 which are operative to cause the internal apparatus within toy vehicle 40 to configure the expression provided by mouth 13 of bumper 12 and moveable eye pupils 31 and 32 together with moveable eyebrows 33 and 34 (all better seen in FIG. 1). Thus, the user simply presses a desired one of buttons 41 through 44 to cause toy vehicle 10 to assume a selected fanciful expression. A button 45 provides an input which allows the user to trigger the operation of a light feature (not shown). A pair of program buttons 58 and 59 is operative to input control information to for vehicle programming while button 57 is operative to initiate movement and operation. A plurality of directional buttons 50 through 56 are supported upon keyboard 40 and are utilized in programming controller 111 (seen in FIG. 6) and set up the travel of toy vehicle 10 in a preprogramming mode. The programming is relatively straight forward in that the user manipulates buttons 58 and 59 and thereafter inputs directional signals and commands to be undertaken by toy vehicle 10 under the control of controller 110 in a sequential manner using buttons 50 through 56. Once toy vehicle 10 has been programmed, the user actuates button 57 and vehicle 10 moves on a pre selected or preprogrammed course as controller 110 executes each selected movement. Controller 111 is conventional in fabrication utilizing a conventional microprocessor and associated memory. Each of the preprogrammed movements and the like are stored within the microprocessor memory.

Figure 3:
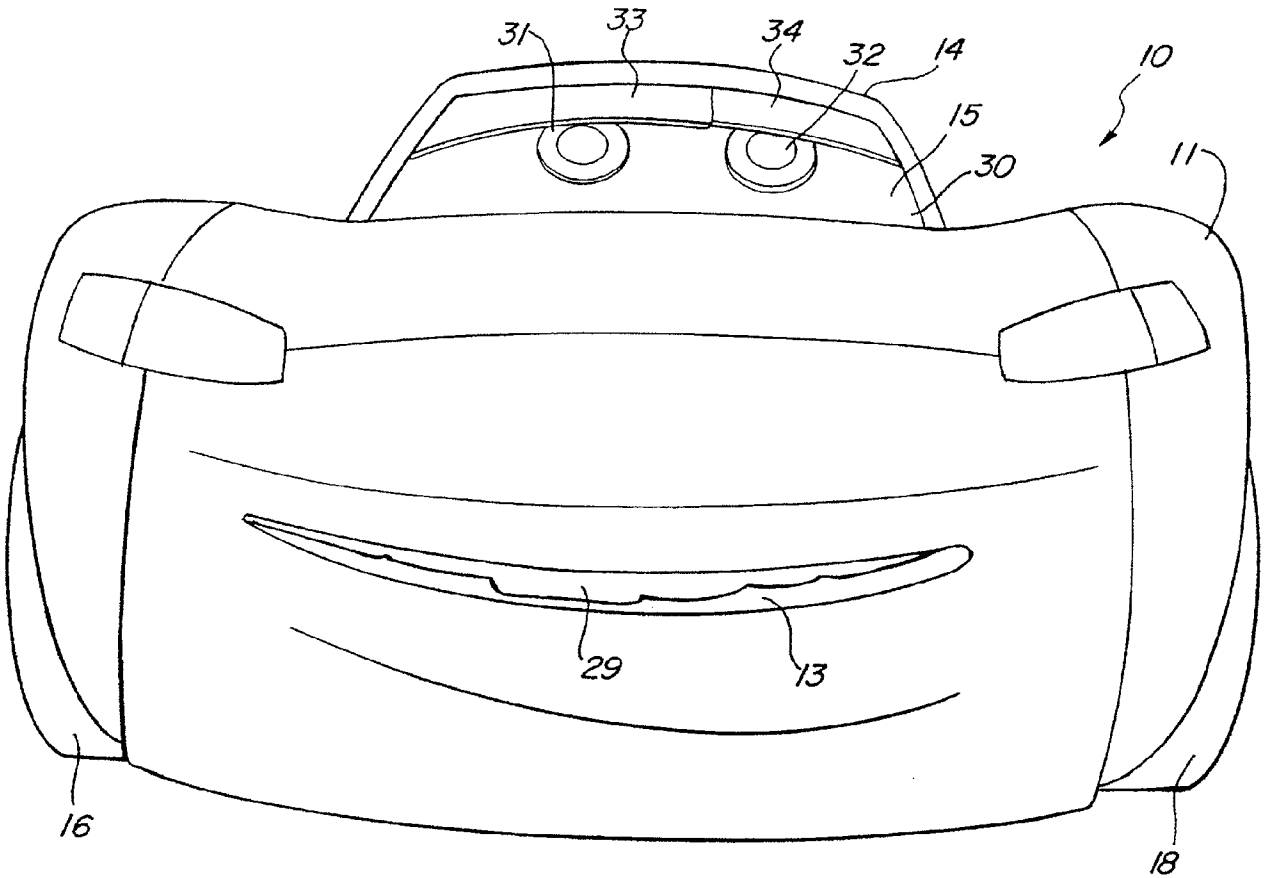
FIG. 3 sets forth a partial front view of the present invention toy vehicle showing the mouth bumper thereof.

FIG. 3 sets forth a partial front perspective view of toy vehicle 10 showing an enlarged view of bumper 12 and mouth 13. As described above, toy vehicle 10 includes a molded plastic body 11 having a roof 14 and a windshield 15. Windshield 15 is formed of a transparent plastic material. A white backing plate 30 is supported behind windshield 15 and a pair of moveable eye pupils 31 and 32 is supported between plate 30 and windshield 15. Also supported between plate 30 and windshield 15 are a pair of moveable simulated eyebrows 33 and 34.

Bumper 12 is preferably formed of a resilient material such as plastic or the like and is secured to the remainder of body 11 in the manner described below. Bumper 12 defines a mouth 13 which is formed by an elongated aperture in bumper 12. In the preferred fabrication of the present invention, a bumper plate 90 (seen in FIG. 4) is supported behind mouth aperture 13 to provide the appearance of simulated white teeth 29 viewable through mouth 13.

In normal operation, by means set forth below in greater detail, the resilient material of bumper 12 is distorted or deformed to cause a corresponding change in the shape of bumper 12 and mouth 13. This changing shape provides the appearance of mouth movement and mouth expressions for vehicle 10.

With simultaneous reference to FIGS. 1, 2 and 3 together, the user operation and programming of toy vehicle 10 is set forth in the attached appendix to the present application. As set forth in the appendix, the user is able to provide a variety of toy vehicle operations and programming by simply manipulating and properly operating user input buttons 41 through 59. As mentioned above, it will be apparent to those skilled in the art that the controller operative within toy vehicle 10 which is referred to as program control 110 seen in FIG. 6 utilizes conventional microprocessor apparatus for programming and control.

Figure 4:
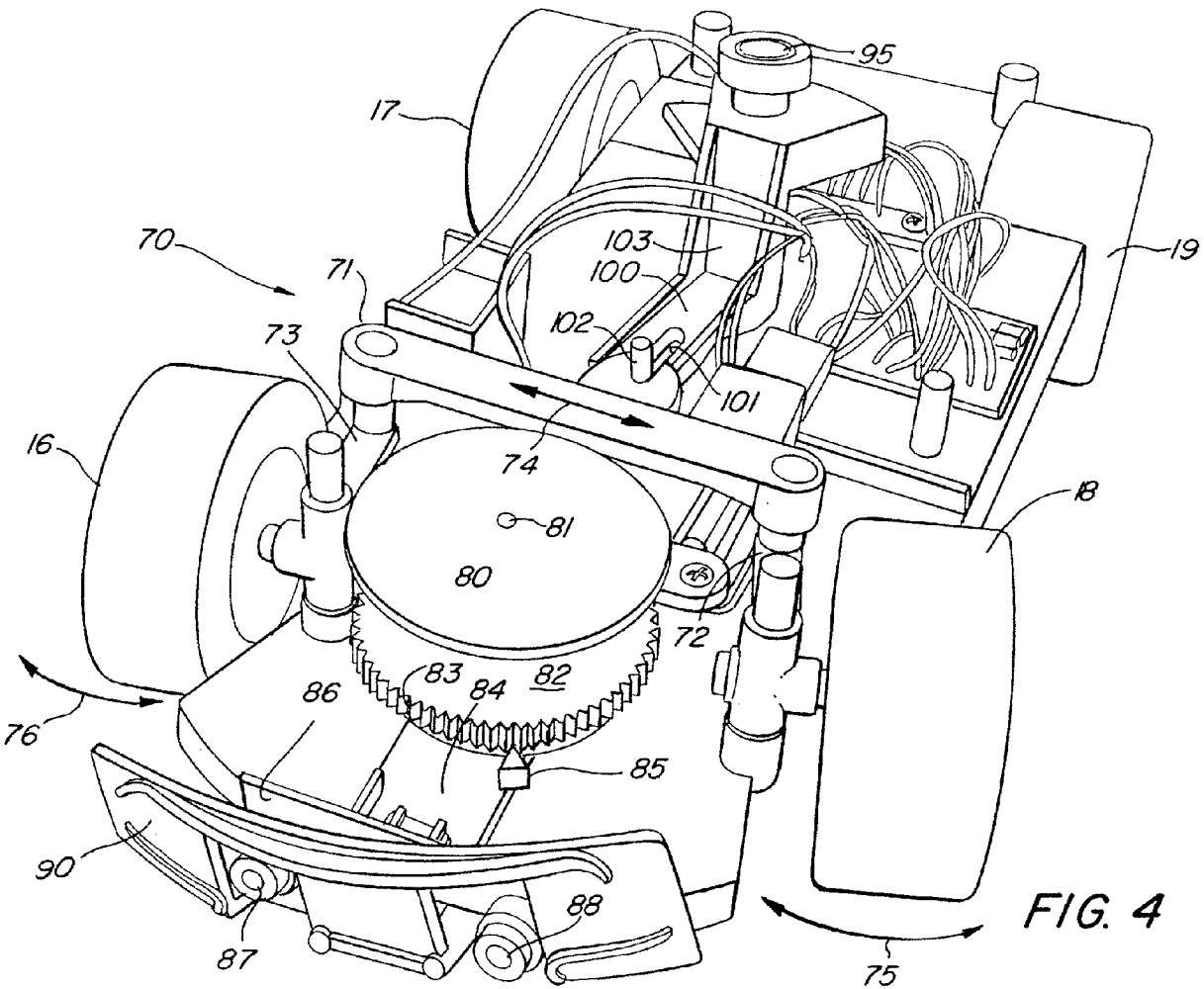
FIG. 4 sets forth a perspective view of the chassis and operative mechanisms of the present invention toy vehicle having the body and bumper removed therefrom.

FIG. 4 sets forth a front perspective view of toy vehicle 10 having body 11 removed therefrom to reveal chassis 70. Chassis 70 is supported by a plurality of wheels 16, 17, 18 and 19 with wheels 16 and 18 being steerable front wheels while wheels 17 and 19 are driven rear wheels. It will be understood that chassis 70 supports a conventional battery power supply and drive motor (not shown) which are constructed entirely in accordance with conventional fabrication techniques.

More specifically, chassis 70 includes a pair of trailing arm assemblies 72 and 73 which supports steerable front wheels 18 and 16 respectively. Trailing arm assemblies 72 and 73 are coupled together via a steering link 71. A lower cam 82 is rotatably supported upon chassis 70 and means not shown is connected to a source of battery powered motor drive via a plurality of gear teeth 83. Lower cam 82 further supports a cam lobe 94. A slide 84 is supported upon chassis 70 and is moveable front to back. Slide 84 is joined to a bumper attachment plate at its forward end. Slide 84 further includes a pair of cam followers 85 and 96 which interact with cam lobe 94. Thus, as lower cam 82 is rotated, cam lobe 94 interacts with cam followers 85 and 96 of slide 84 to move slide 84 upon chassis 70. Bumper attachment plate 86 further includes a pair of forwardly extending posts 88 and 87. Posts 88 and 87 receive and support bumper 12 (seen in FIG. 1). A bumper plate 90 is slideably moveable upon chassis 70 and is secured to the back side of bumper 12 by means better seen in FIG. 7. Lower cam 82 is further coupled to a moveable traveler 100 which defines a slot 101 receiving a chassis post 102. Traveler 100 is coupled to lower cam 82 by a post 93. Traveler 100 is moved forwardly and backwardly within chassis 70 and includes a riser 103 which in turn supports a socket member 95. By means not shown, socket member 95 is coupled to the operative mechanism which controls simulated eye pupils 31 and 32 as well as moveable eyebrows 33 and 34 (seen in FIG. 1). It will be understood that the operative mechanism utilized in moving simulated eye pupils 31 and 32 as well as simulated eyebrows 33 and 34 comprises the mechanism set forth in the above referenced incorporated provisional patent application and described herein with respect to FIGS. 8-12. Suffice it to note here that as traveler 100 is moved, socket 95 is correspondingly moved causing movement of the eyes and eyebrows of toy vehicle 10.

Figure 5:
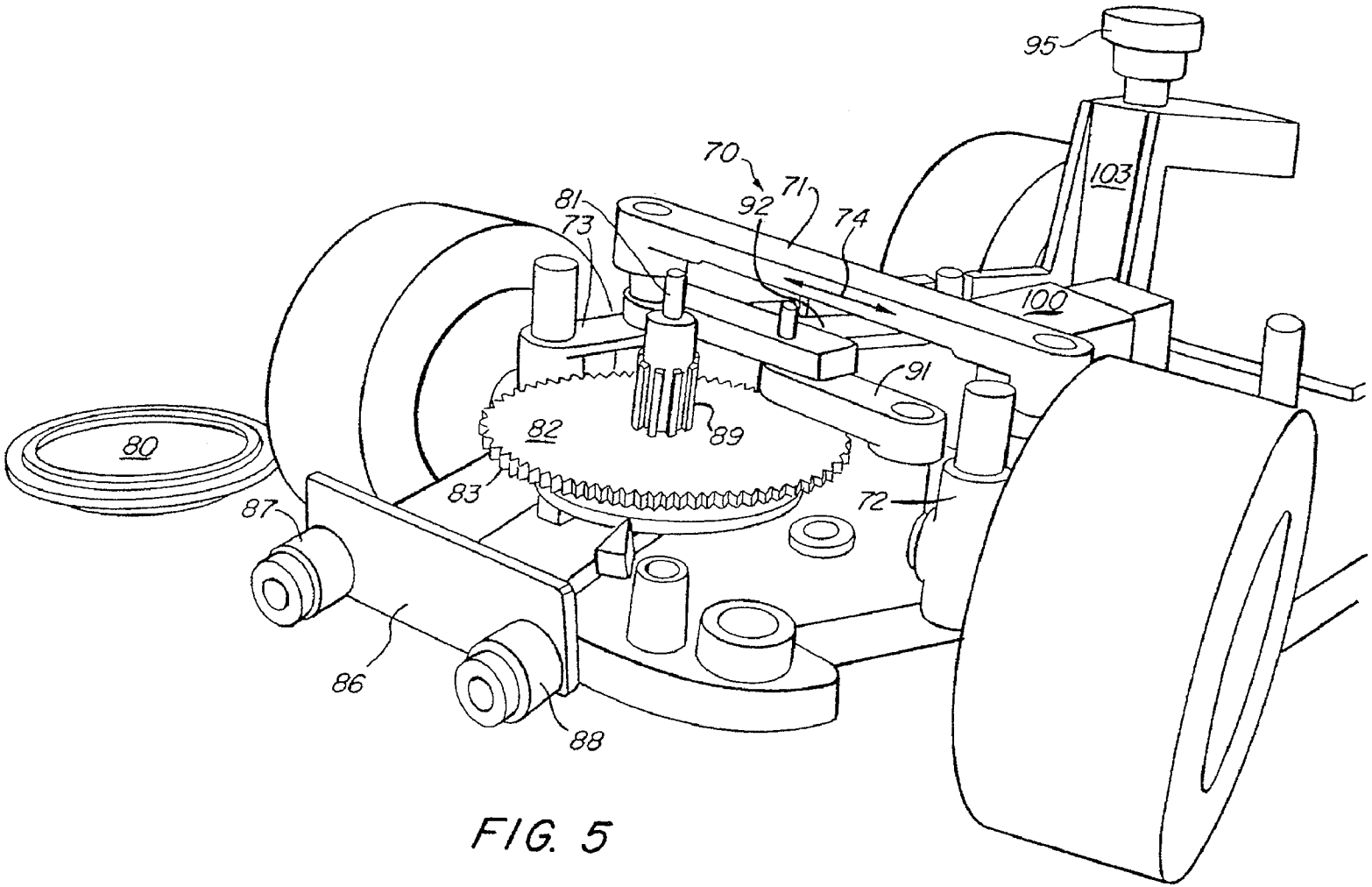
FIG. 5 sets forth a partial front perspective view of the operative mechanism of the toy vehicle chassis in FIG. 4.

An upper cam 80 is supported by post 81 for rotation and by means not shown engages spline 89 of lower cam 82 (seen in FIG. 5). Thus rotation of lower cam 82 produces a corresponding rotation of upper cam 80.

Figure 6:
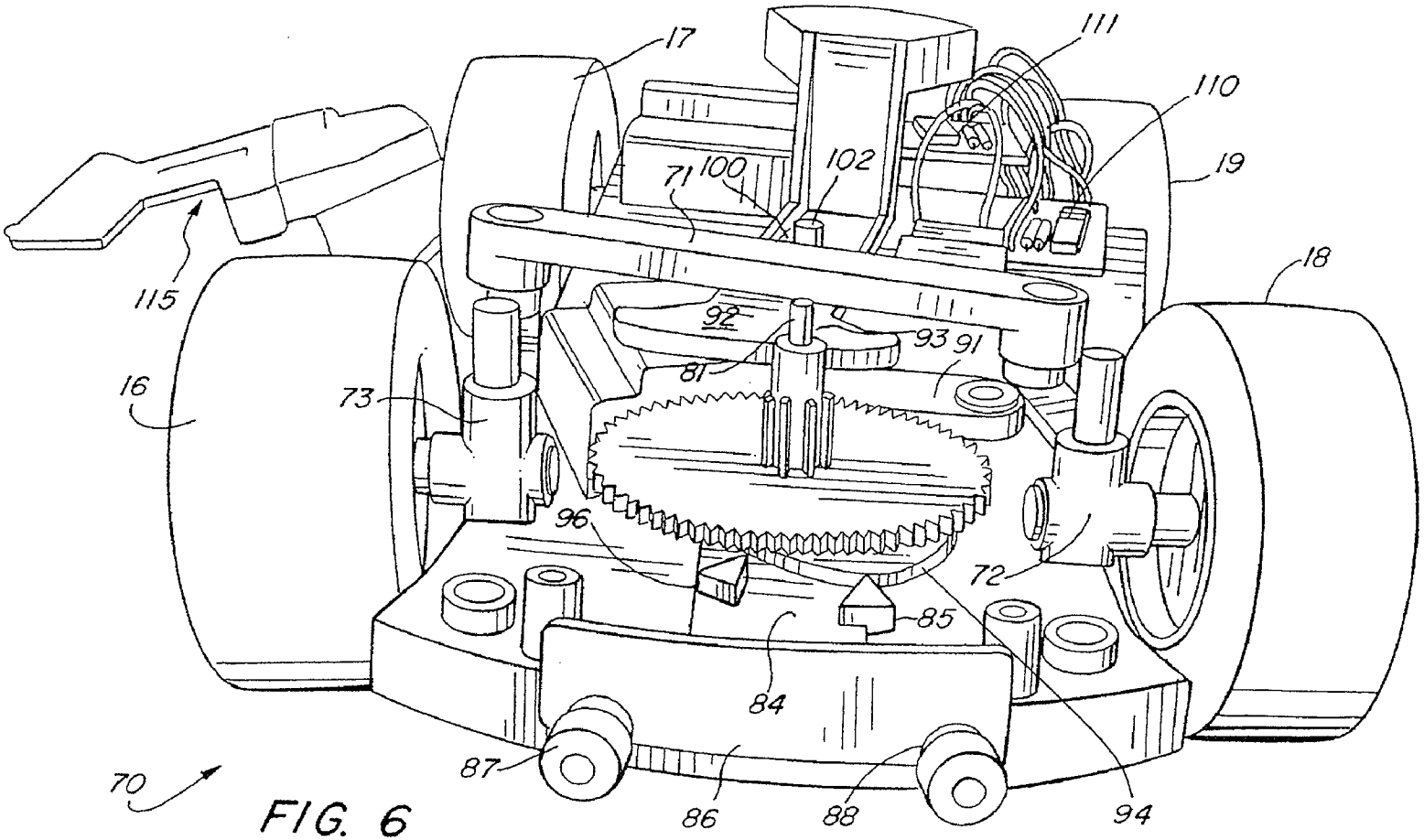
FIG. 6 sets forth a further partial perspective view of the toy vehicle chassis and operative mechanism set forth in FIG. 4.

Referring to FIGS. 5 and 6 simultaneously, toy vehicle 10 is shown having body 11 removed to expose the details of chassis 70 and the operative apparatus utilized therein. In addition, upper cam 80 has been removed from post 81 to facilitate a better view of splines 89 and link 92. Link 92 is situated at the forward end of traveler 100. Link 92 is further coupled to a link 91 by a post 93 (better seen in FIG. 5).

Figure 7:
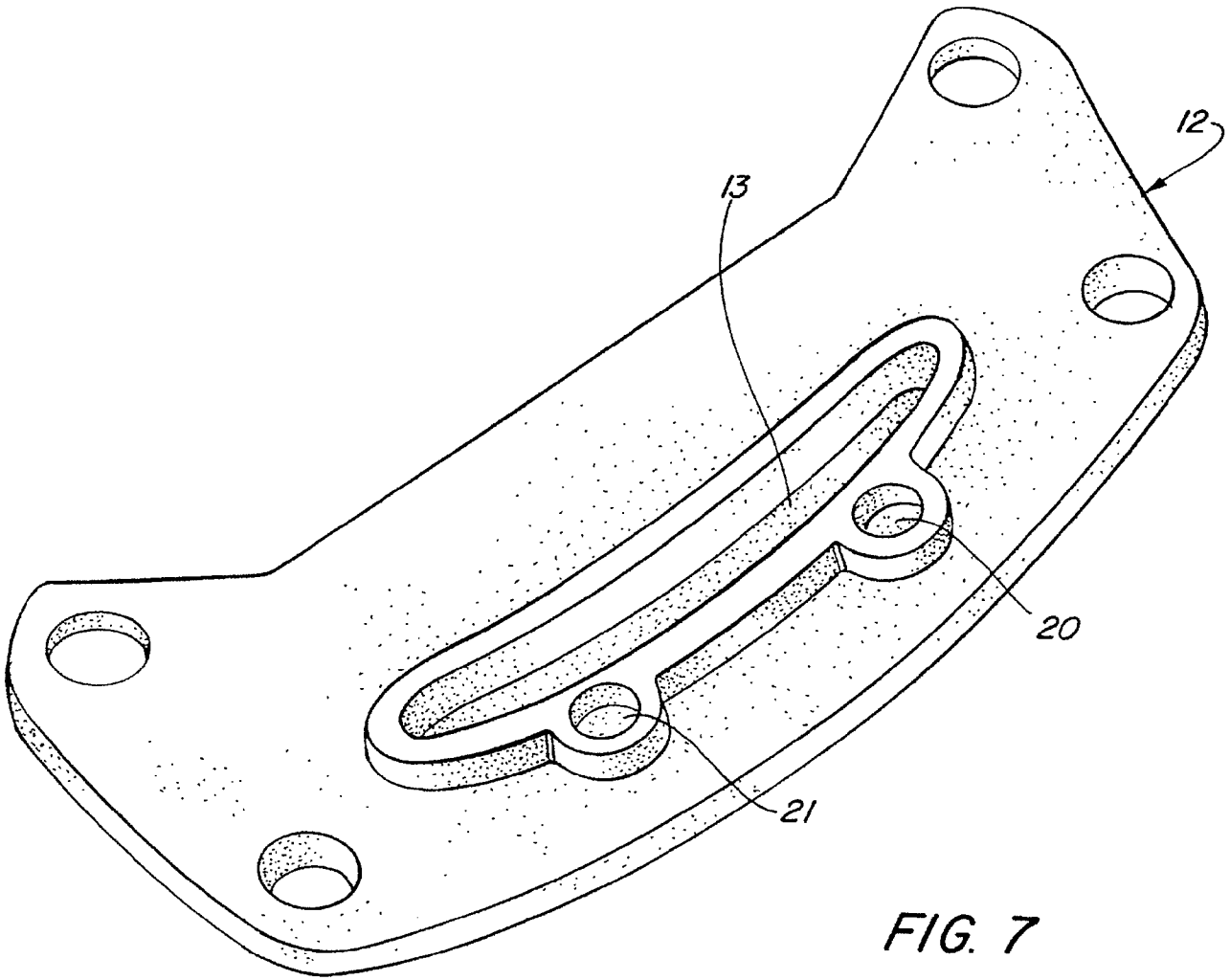
FIG. 7 sets forth a perspective rear view of the flexible bumper and mouth of the present invention toy vehicle.

FIG. 7 sets forth a rear perspective view of bumper 12 showing mouth 13 together with a pair of generally cylindrical receptacles 20 and 21. Receptacles 20 and 21 receive posts 88 and 87 of bumper attachment plate 86 (seen in FIG. 4). In addition, bumper plate 90 is positioned against the rear side of bumper 12 to provide further forming of bumper 12.

Figure 8:
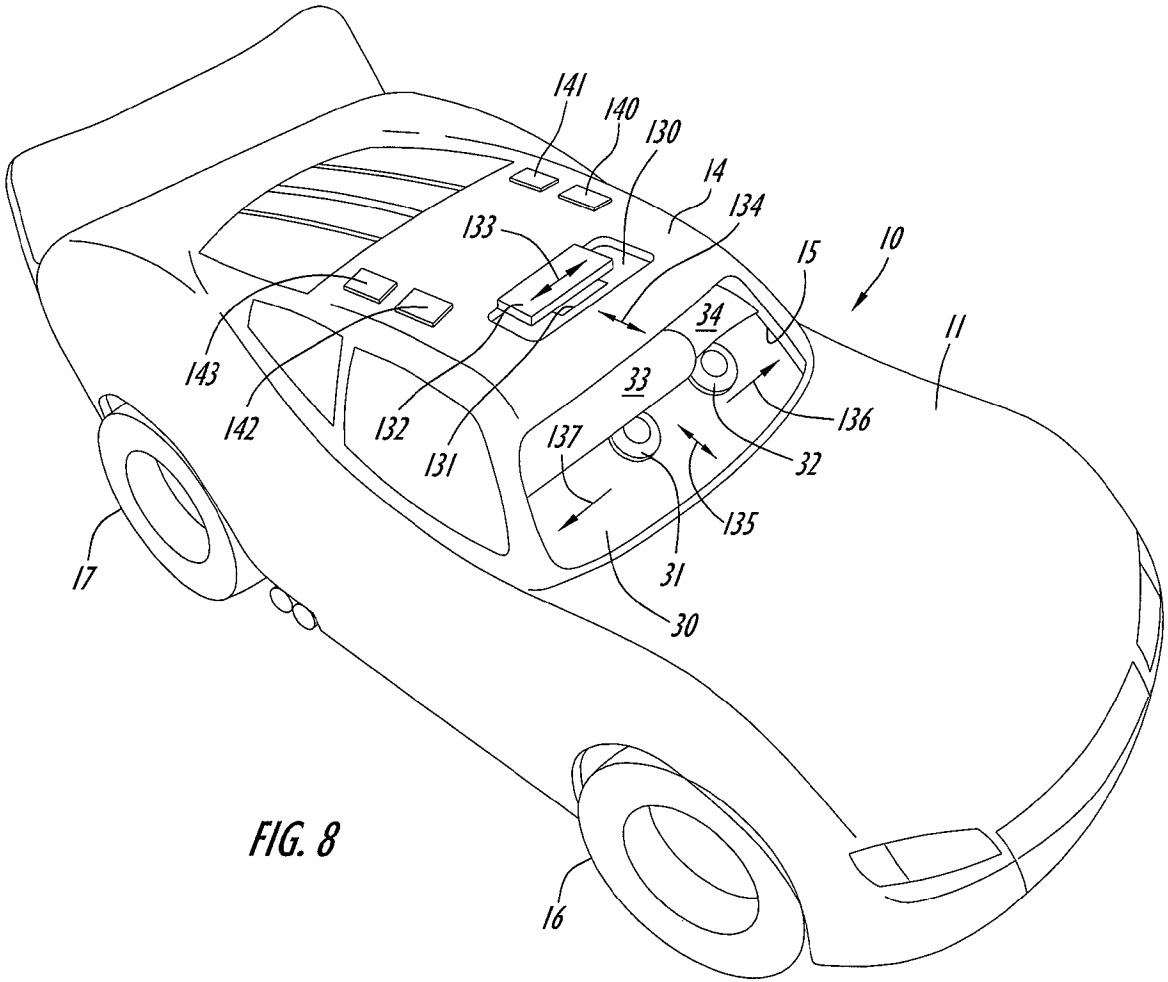
FIG. 8 sets forth a front perspective view of a toy vehicle constructed in accordance with the present invention having the simulated eyes raised.

Referring to FIG. 8, in one embodiment, body 11 further includes a roof portion 14 upon which a button recess 130 is formed. Within recess 130, a slot 131 is formed which receives a movable button 132. Roof 14 further supports a plurality of sound buttons 140, 141, 142 and 143 which are coupled to sound circuit 155 (seen in FIG. 12).

As mentioned above, toy vehicle 10 includes a white colored backing plate 30 positioned behind windshield 15. Between windshield 15 and backing plate 30, a pair of simulated eye pupils 31 and 32 is supported by an eye carry 160 (seen in FIG. 11). Toy vehicle 10 further includes a pair of simulated eyebrows 33 and 34 which is also positioned between backing plate 30 and windshield 15. The support and movement apparatus for simulated eye pupils 31 and 32 as well as simulated eyebrows 33 and 34 is set forth below in greater detail in FIG. 12. Suffice it to note here however that the operative mechanisms supporting simulated eye pupils 31 and 32 and simulated eyebrows 33 and 34 is operative coupled to button 132. As a result, movement of button 132 in the directions indicated by arrows 133 (side to side) results in movement of simulated eye pupils 31 and 32 in the directions indicted by arrows 136 and 137. Correspondingly, and as is set forth below in FIG. 10 in greater detail, movement of simulated eye pupils 31 and 32 results in a corresponding movement of simulated eyebrows 33 and 34. Similarly, movement front to back of button 132 in the directions indicated by arrows 134, results in corresponding movement of simulated eye pupils 31 and 32 and simulated eyebrows 33 and 34 in the directions indicated by arrows 135. More specifically, moving button 132 rearwardly raises simulated eye pupils 31 and 32 and simulated eyebrows 33 and 34. Conversely, pushing button 132 forward lowers simulated eye pupils 31 and 32 and simulated eyebrows 33 and 34.

Figure 9:
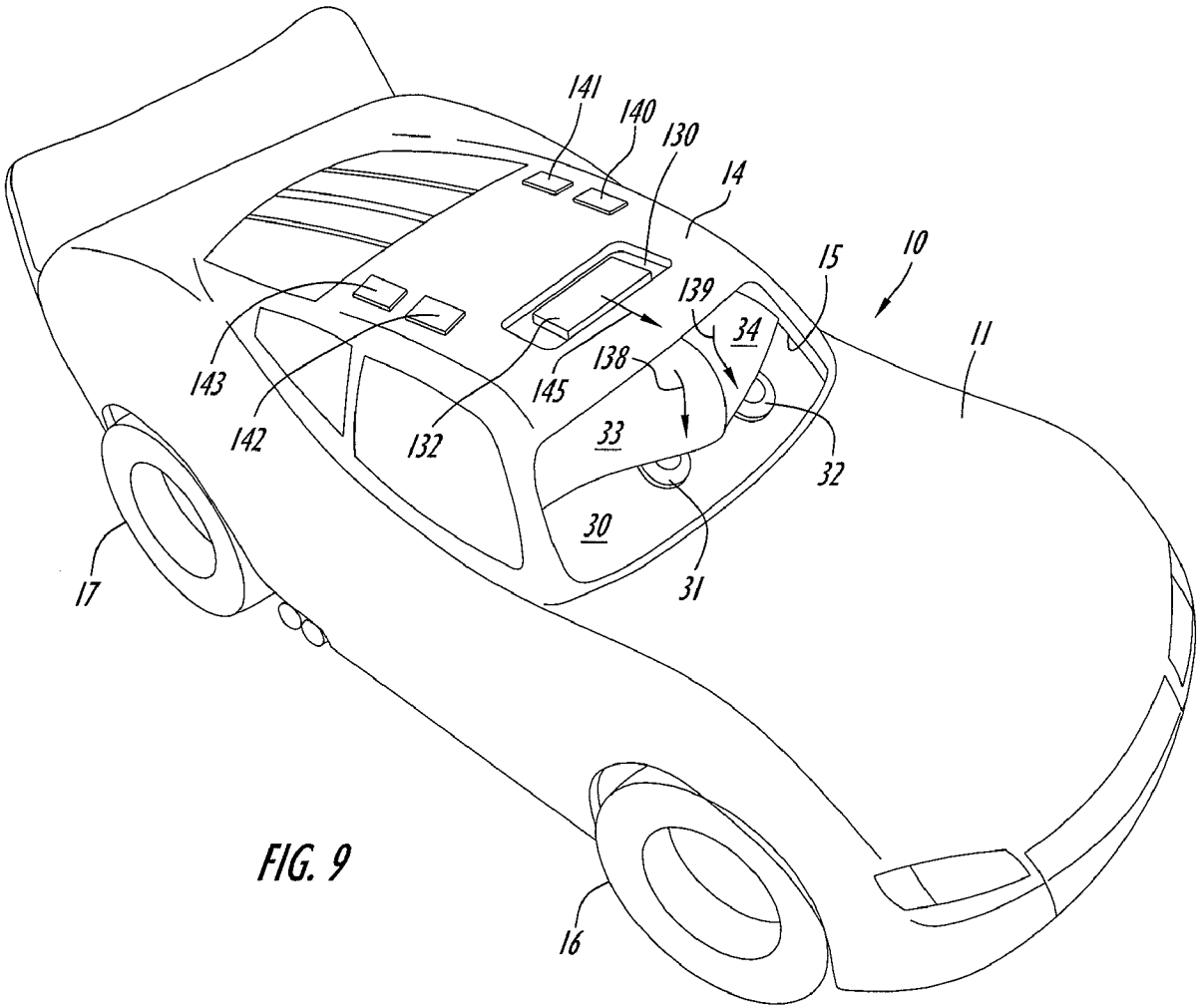
FIG. 9 sets forth a front perspective view of the present invention toy vehicle having the simulated eyes moved to provide a "frowning" expression.

By way of example, F*igure* 8 shows the relative positions of simulated eye pupils 31 and 32 and simulated eyebrows 33 and 34 which result from pushing button 132 rearwardly. Conversely, the "expression" resulting from pushing button 132 forwardly in which simulated eye pupils 31 and 32 as well as simulated eyebrows 33 and 34 are lowered or "frowning" is shown in FIG. 9, which sets forth a front perspective view of toy vehicle 10. Finally, the response of simulated eye pupils 31 and 32 and simulated eyebrows 33 and 34 to a sideways movement of button 132 is shown in FIG. 10.

Sound buttons 140, 141, 142 and 143 are operative to cause sound circuit 155 (seen in FIG. 11) to produce a different corresponding sound.

In the operative positions shown in FIG. 9, button 132 has been moved forwardly within recess 130 in the direction indicated by arrow 145. The corresponding movement provided by the operative linkage coupled to button 132 (set forth in FIG. 12) causes simulated eye pupils 31 and 32 to move downwardly to the position shown in FIG. 9. The white backing plate 30 positioned behind windshield 15 provides the operative space for movement of simulated eye pupils 31 and 32. Simulated eyebrows 33 and 34 also positioned between backing plate 20 and windshield 15 and also coupled to the operative mechanism moved by button 132 are caused to move downwardly and inwardly in the directions indicated by arrows 138 and 139. The support of simulated eyebrows 33 and 34 within body 11 seen in FIG. 12 results in this forward and tilted movement of simulated eyebrows 33 and 34 which is responsible for the "frowning" expression which is fancifully depicted by simulated eye pupils 31 and 32 and simulated eyebrows 33 and 34.

Figure 10:
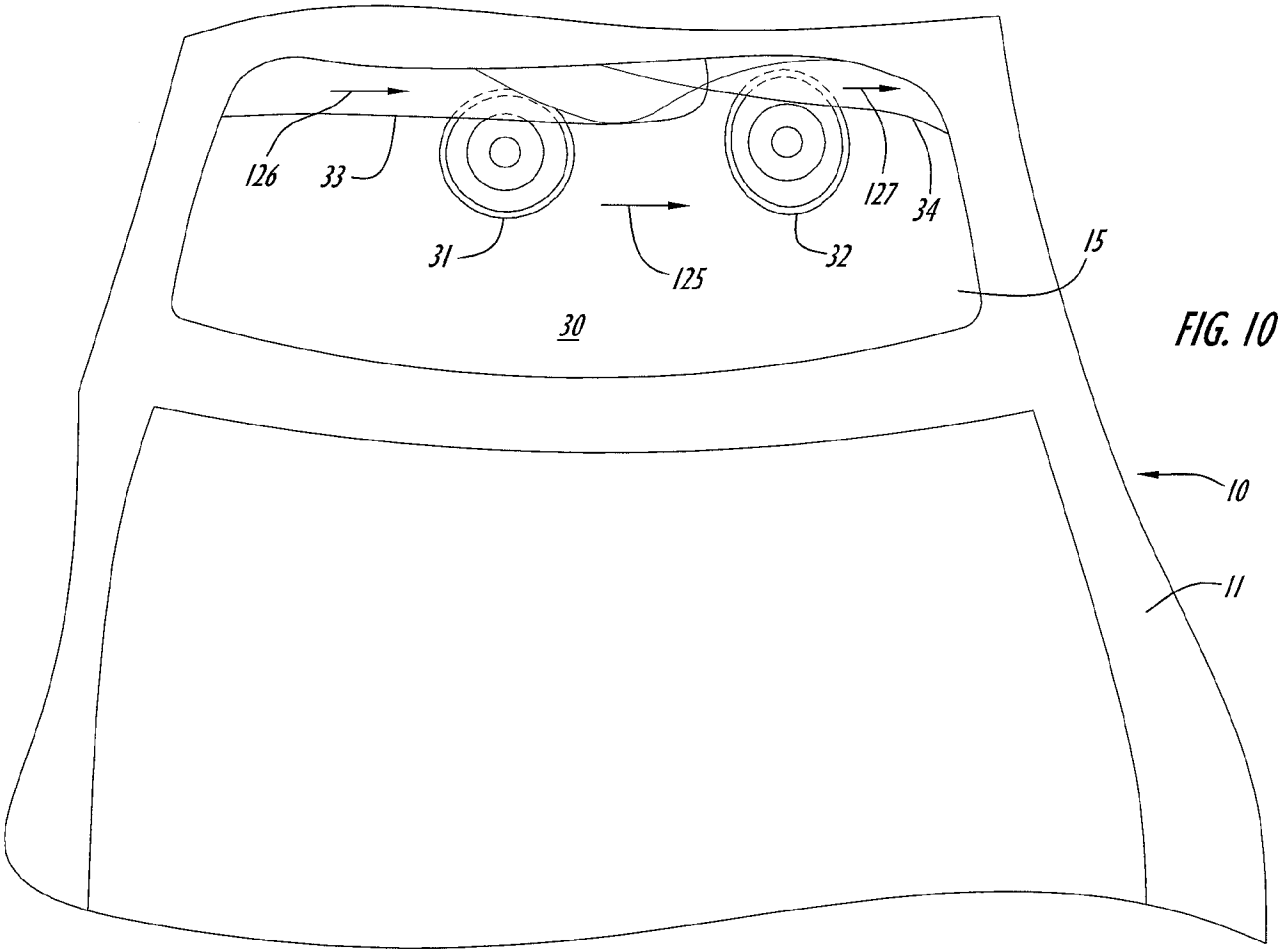
FIG. 10 sets forth a partial front view of the simulated eyes and eyebrows within the toy vehicle windshield.

FIG. 10 sets forth a partial front view of toy vehicle 10 showing body 11 supporting a clear plastic windshield 15. In the configuration shown in FIG. 10, button 132 (seen in FIG. 9) has been moved in the direction indicated by arrow 125. Correspondingly, simulated eye pupils 31 and 32 are also moved in the direction indicated by arrow 125. The interactive coupling of the operative mechanism which supports and moves simulated eye pupils 31 and 32 also operates to move simulated eyebrows 33 and 34 in the direction indicated by arrows 126 and 127 respectively. Once again, it will be noted that the expression value of the operative mechanism which moves simulated eyebrows 33 and 34 provides a tilting action for eyebrow 34 in response to this sideways movement. This further enhances the quality of fanciful expression provided.

Figure 11:
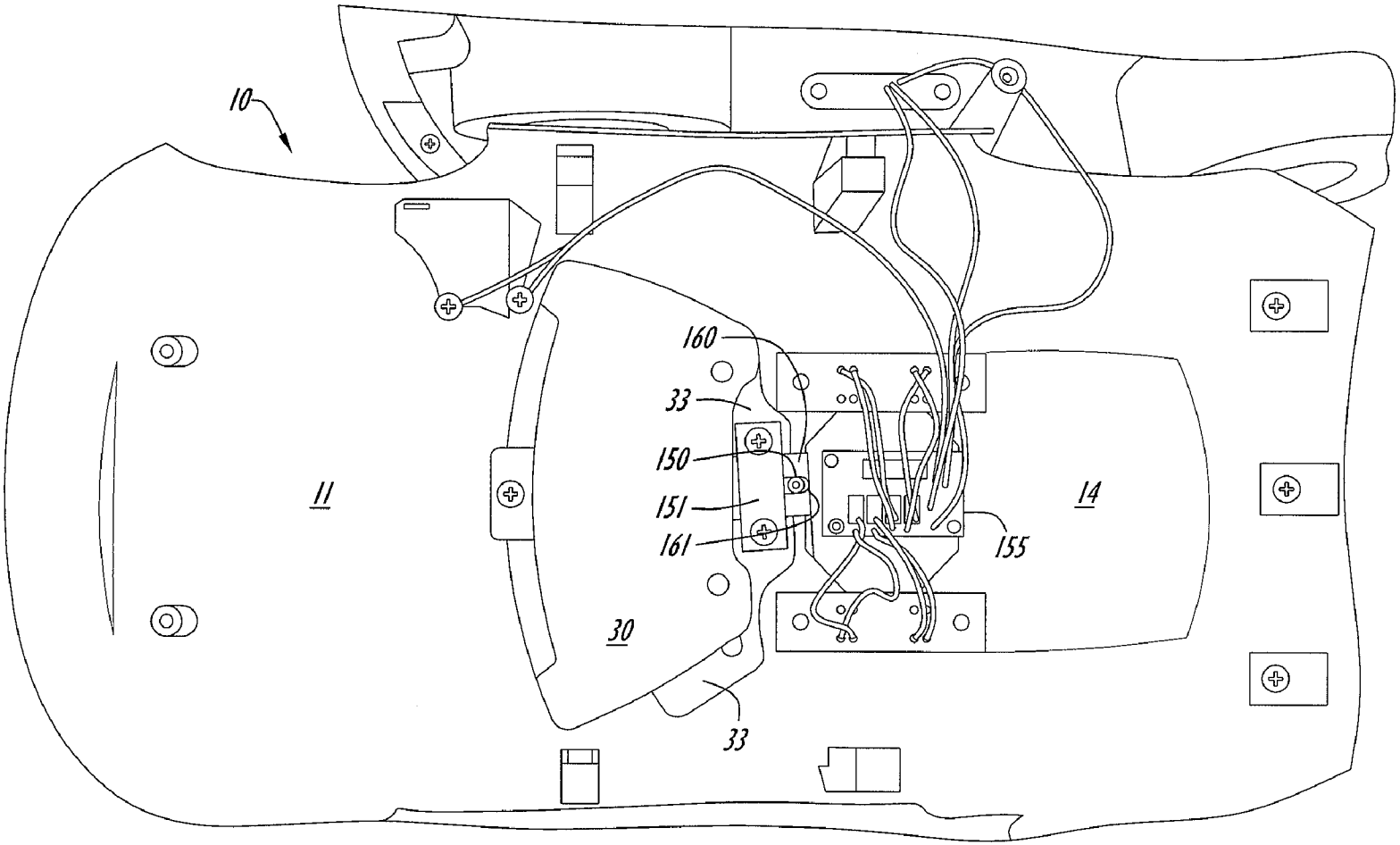
FIG. 11 sets forth a bottom perspective view a the present invention toy vehicle showing the windshield backing plate installed.

FIG. 11 sets forth a bottom view of body 11 removed from the remainder of toy vehicle 10. As mentioned above, body 11 is preferably formed of a molded plastic material or the like and defines a roof portion 14. As is also described above, body 11 supports a clear transparent windshield 15 (seen in FIG. 12). A conventional sound circuit 155 is operatively coupled to a plurality of buttons supported on roof 14 (buttons 140 through 143 shown in FIG. 8). Sound circuit 155 responds to any of the coupled buttons being activated by producing a characteristic or particular sound.

Body 11 further defines a downwardly extending post 150. An eye carrier 160 better seen in FIG. 12 defines an elongated slot 161 which is received upon post 150 to provide limited movement of eye carrier 160. A plate 151 is secured to eye carrier 160 and is further coupled to button 132 (seen in FIG. 8) by a pair of conventional fasteners.

In the bottom view of body 11 shown in FIG. 11, backing plate 30 is secured behind windshield 15 and maintained by a plurality of conventional fasteners. A pair of simulated eyebrows 33 and 34 is secured beneath backing plate 30.

Figure 12:
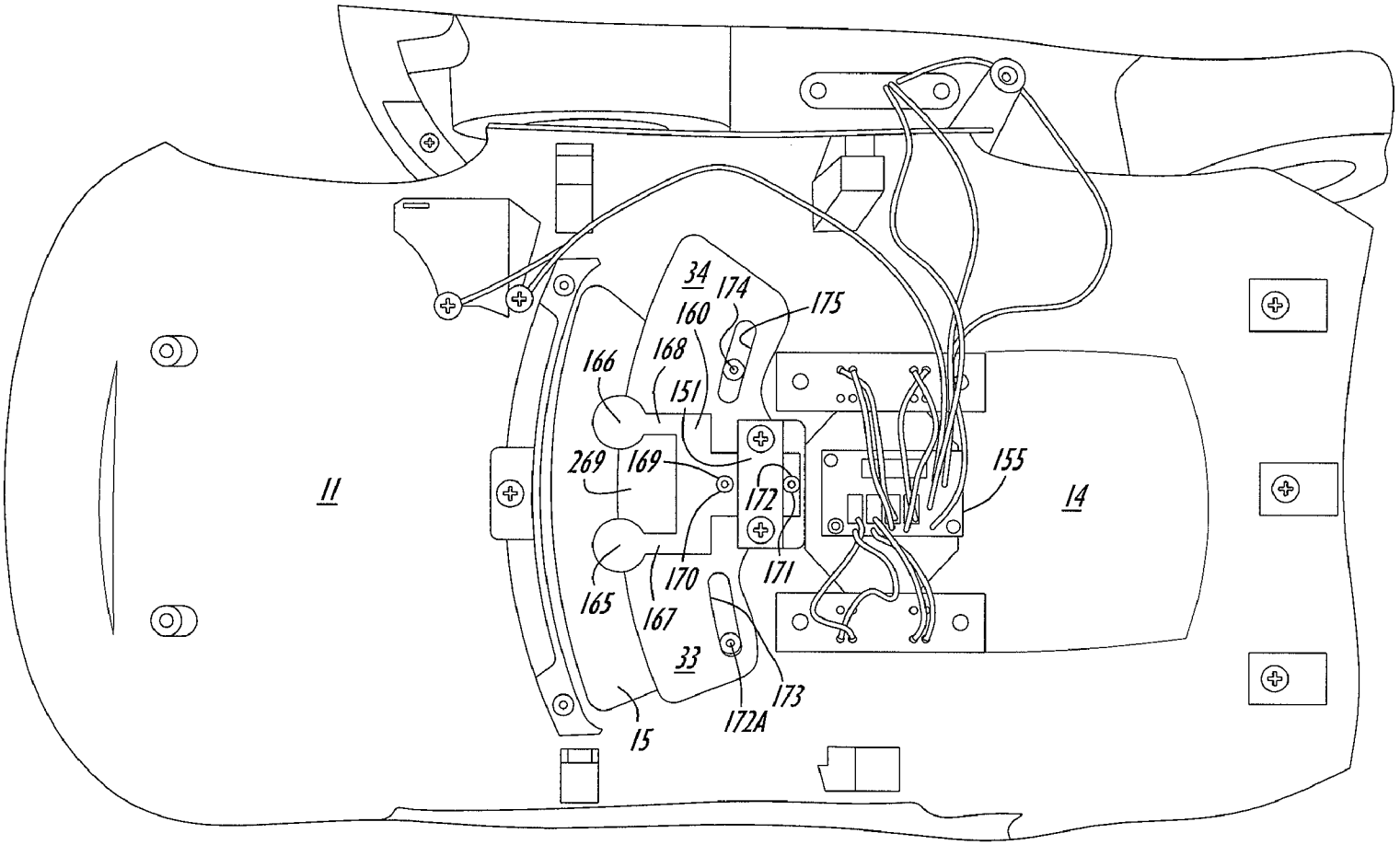
FIG. 12 sets forth a bottom perspective view having the windshield backing plate removed to reveal the operative mechanism of the simulated eyes and eyebrows.

FIG. 12 sets forth a bottom view of body 11 removed from the remainder of toy vehicle 10 as set forth above in FIG. 11. However, for purposes of illustration, FIG. 12 shows toy vehicle 10 having backing plate 30 removed. A conventional sound circuit 155 is secured within body 11 and is operatively coupled to a plurality of buttons 140 through 143 (seen in FIG. 8). Windshield 15 is preferably formed of a transparent plastic material or the like and is secured to body 11 by conventional attachment means. Body 11 further defines a post 171 extending downwardly from roof portion 14 and a pair of posts 172A and 174 extending downwardly from the forward portion of roof 14. A pair of simulated eyebrows defines generally curved planar members 33 and 34. Simulated eyebrows 33 and 34 are positioned against the inside surface of windshield 15 and define respective slots 173 and 175 which receive posts 172A and 174. The cooperation of posts 172A and 174 within slots 173 and 175 control the type of movement enjoyed by simulated eyebrows 33 and 34 as button 132 (seen in FIG. 8) is moved by the user. Button 132 is secured by conventional fasteners to a plate 151. An eye carrier 160 defines a generally planar member having a slot 172 received upon post 171 together with an aperture 170 which receives post 169. Eye carrier 160 further includes a member 269 which further supports a pair of forwardly extending arms 167 and 168. Arms 167 and 168 are joined to a pair of generally circular eye pupil pads 165 and 166. Pads 165 and 166 receive and support simulated eye pupils 31 and 32 (seen in FIG. 8).

By means described above, movement of button 132 (seen in FIG. 8) causes a corresponding movement of eye carrier 160 which in turn moves simulated eyebrows 33 and 34 together with eye pads 165 and 166. Movement of eye pads 165 and 166 in turn moves simulated eye pupils 31 and 32. In this fashion, button 132 (seen in FIG. 8) is operative to provide eyebrow and eye pupil movement to provide the above described simulated expressions of the fanciful toy vehicle of the present invention.

What has been shown is a novel toy vehicle which is capable of substantial fanciful facial expressions and programmed drive operations. The drive operation the vehicle and the facial expressions are further controllable by direct keyboard input. What has been shown is a toy vehicle having fanciful eyes which are moveable in response to a child operated button. The fanciful expressions provided by the movement of simulated eyes and eye brows provides an amusing almost comic fanciful expression set for the toy vehicle.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a body having a windshield, a windshield aperture, and a deformable bumper having a mouth aperture formed therein;

a pair of movable eye pupils supported in said windshield;

a pair of movable eyebrows supported in said windshield;

a drive system supported within said body having a movement mechanism that moves said deformable bumper, said eye pupils and said eyebrows; and a control mechanism for controlling said drive system said body further including a backing sheet covering said windshield aperture, said backing sheet being supported behind said movable eye pupils.

2. The toy vehicle set forth in claim 1, wherein said control mechanism accumulates input commands from user inputs to establish a sequence of execution for said toy vehicle.

3. The toy vehicle set forth in claim 1, wherein the body includes user inputs, and said user inputs include a plurality of depressible buttons.

4. The toy vehicle set forth in claim 1, wherein the backing sheet is opaque.

5. The toy vehicle set forth in claim 1, wherein the body includes at least one drive wheel and at least one steerable wheel, and the drive system includes a drive mechanism that is connected to and configured to drive the at least one drive wheel while the movement mechanism moves said eye pupils and eyebrows.

6. The toy vehicle set forth in claim 5, wherein the drive system includes a steering mechanism connected to the at least one steerable wheel, and the control mechanism can control a sequence of movements of the movement mechanism, the drive mechanism, and the steering mechanism.

7. The toy vehicle set forth in claim 1, wherein a portion of the movement mechanism is manually operable.

8. The toy vehicle set forth in claim 7, wherein the portion is a button that can be moved in a first direction and in a second direction, the movement of the button in the first direction resulting in the eye pupils and the eyebrows moving along the first direction, and the movement of the button in the second direction resulting in the eye pupils and the eyebrows moving along the second direction.

9. The toy vehicle set forth in claim 1, wherein the movable eyebrows are pivotally coupled to the body.

10. The toy vehicle set forth in claim 1, wherein the eye pupils and eyebrows are moved relative to the windshield simultaneously.

11. A toy vehicle comprising:

a body having a windshield aperture, a windshield, a plurality of wheels, and a backing sheet covering said windshield aperture;

a pair of movable eye pupils;

a first mechanism for supporting and moving said eye pupils behind said windshield, said backing sheet being supported behind said movable eye pupils;

a pair of movable eyebrows;

a second mechanism for supporting and moving said eyebrows behind said windshield;

a deformable front bumper defining a mouth aperture therein;

a third mechanism for supporting and deforming said front bumper upon said body;

a controller operatively coupled to control said first mechanism and said second mechanism to create facial expressions for said toy vehicle; and a plurality of user inputs coupled to the body for providing user programming inputs to said controller, said controller accumulating input commands from said user inputs to establish a sequence of execution for said toy vehicle.

12. The toy vehicle set forth in claim 11, wherein said user inputs include a plurality of depressible buttons.

13. The toy vehicle set forth in claim 12, wherein said controller controls said third mechanism.

14. The toy vehicle set forth in claim 11, wherein said controller controls said third mechanism.

15. A toy vehicle, comprising:

a body having a first aperture and a deformable bumper coupled to the body that defines a second aperture;

at least one movable eye member coupled to the body located proximate to the first aperture;

at least one movable eyebrow coupled to the body located proximate to the first aperture; and a drive mechanism disposed in the body, the drive mechanism being connected to the deformable bumper to change the shape of the second aperture, the drive mechanism being connected to the at least one movable eye member and the at least one movable eyebrow to move the at least one movable eye member and the at least one movable eyebrow relative to the first aperture, wherein the movement of the at least one movable eye member, the at least one movable eyebrow, and the deformable bumper creates an expression for the toy vehicle.

16. The toy vehicle set forth in claim 15, wherein the body has a windshield disposed in the first aperture and a backing member proximate to the windshield, the at least one movable eye member being disposed between the windshield and the backing member.

17. The toy vehicle set forth in claim 15, wherein the drive mechanism includes a system for moving the at least one movable eye member and the at least one movable eyebrow simultaneously.

18. The toy vehicle set forth in claim 15, wherein the body includes at least one wheel coupled thereto, and the drive mechanism is connected to the at least one wheel to impart motion to the at least one wheel and the body.

19. The toy vehicle set forth in claim 15, wherein the body includes a wheel coupled thereto, and the toy vehicle further comprises:

a controller that controls the drive mechanism so that the drive mechanism executes a sequence of movements, one of the movements including driving the wheel.

20. The toy vehicle of claim 19, wherein the wheel is a first wheel and the body includes a second wheel coupled thereto, and the drive mechanism includes a steering mechanism coupled to the second wheel that steers the second wheel relative to the body, and the sequence of movements includes moving the at least one eye member, moving the at least one eyebrow, steering the second wheel, driving the first wheel, and moving the deformable bumper.

* * * * *